US007594384B2

(12) United States Patent
Wassenhoven

(10) Patent No.: US 7,594,384 B2
(45) Date of Patent: Sep. 29, 2009

(54) SPINNING ROTOR

(75) Inventor: Heinz-Georg Wassenhoven, Mönchengladbach (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 43 days.

(21) Appl. No.: 11/920,221

(22) PCT Filed: Apr. 11, 2006

(86) PCT No.: PCT/EP2006/003311

§ 371 (c)(1),
(2), (4) Date: Nov. 9, 2007

(87) PCT Pub. No.: WO2006/119834

PCT Pub. Date: Nov. 16, 2006

(65) Prior Publication Data

US 2009/0084081 A1 Apr. 2, 2009

(30) Foreign Application Priority Data

May 12, 2005 (DE) ..... 10 2005 021 920

(51) Int. Cl.
*D01H 4/10* (2006.01)

(52) U.S. Cl. ..... 57/404

(58) Field of Classification Search ..... 57/404–417
See application file for complete search history.

(56) References Cited

U.S. PATENT DOCUMENTS

| | | | | |
|---|---|---|---|---|
| 3,875,732 | A * | 4/1975 | Ellingham | 57/406 |
| 4,170,102 | A | 10/1979 | Whiteley | 57/58.89 |
| 4,319,449 | A * | 3/1982 | Hofmann | 57/404 |
| 4,503,663 | A * | 3/1985 | Oexler | 57/404 |
| 5,526,638 | A * | 6/1996 | Bock et al. | 57/404 |
| 5,634,326 | A * | 6/1997 | Wanger | 57/406 |
| 5,802,838 | A * | 9/1998 | Bock | 57/406 |
| 6,195,976 | B1 | 3/2001 | Wassenhoven et al. | 57/414 |
| 6,863,466 | B2 * | 3/2005 | Buhren | 403/383 |

FOREIGN PATENT DOCUMENTS

| | | |
|---|---|---|
| DE | 28 12 297 | 9/1978 |
| DE | 3519536 A1 | 12/1986 |
| DE | 40 20 518 A1 | 1/1992 |
| DE | 1 991 277 | 9/2000 |
| DE | 103 02 178 A1 | 7/2004 |
| EP | 0 464 401 A1 | 1/1992 |

* cited by examiner

*Primary Examiner*—Shaun R Hurley
(74) *Attorney, Agent, or Firm*—K&L Gates LLP

(57) ABSTRACT

Spinning rotor (1) for an open end rotor spinning machine comprising a rotor shaft (2), a rotor cup (3), which has an opening (4), an inner chamber (5), a rotor groove (6), a conically widening slide wall (7) extending from the opening (4) to the rotor groove (6) and a rotor base (9) arranged opposing the opening (4) and designed with a bore (8), through which the rotor shaft (2) extends at least partially. The rotor shaft (2) is connected by means of a connection element (10) to the rotor cup (3) and the rotor shaft (2) and rotor cup (3) comprise a common rotational axis (13). The rotor shaft (2) and the rotor cup (3) have connection means (11, 12), which are at least partially surrounded by the connection element (10) configured as a cast part, so a positive connection of the rotor shaft (2) to the rotor cup (3) can be achieved.

16 Claims, 1 Drawing Sheet

SPINNING ROTOR

CROSS-REFERENCES TO RELATED APPLICATIONS

This application claims the benefit of German patent application 10 2005 021 920.9, filed May 12, 2005, herein incorporated by reference.

BACKGROUND OF THE INVENTION

The invention relates to a spinning rotor for an open end rotor spinning machine, particularly a spinning rotor comprising a rotor shaft, a rotor cup having an opening, an inner chamber, a rotor groove, a conically widening slide wall extending from the opening to the rotor groove and a rotor base arranged opposing the opening and designed with a bore, through which the rotor shaft extends at least partially, wherein the rotor shaft is connected by means of a connection element to the rotor cup and the rotor shaft and rotor cup comprise a common rotational axis.

In conjunction with open end rotor spinning machines, a large number of the most varied spinning rotors are known from the patent literature and generally consist of a rotor shaft for mounting the spinning rotor and a rotor cup for producing a thread. Spinning rotors of this type in modern open end spinning machines reach rotational speeds of far above 100,000 $min^{-1}$. Rotational speeds that are as high as this in total place special demands with regard to imbalance, mounting and stability of spinning rotors of this type. As spinning rotors of this type are heavily stressed, for example as a result of mechanical vibrations, the highest demands are also made of the fastening between the rotor shaft and rotor cup.

Spinning rotors are described, for example, in German Patent Publications DE-OS 28 12 297 or DE 199 10 77 A1, in which the rotor cups are connected to the rotor shaft, in each case via a hub, into which a bore is let. The connection is implemented as a press fit here and is non-releasable.

Furthermore spinning rotors are known from German Patent Publications DE 40 20 518 A1 or DE 103 02 178 A1, in which the rotor cups only have one central bore in the region of the rotor base, in which the rotor shaft is inserted. The rotor shaft is, in this case, equipped with a bearing collar, on which the rotor cup is fixed by a weld connection. A weld connection for fixing a rotor cup on the rotor shaft is also described in German Patent Publication DE 3519 536 A1. In this known device, the rotor cup has an extra thick base. The rotor shaft is fixed to this rotor cup base by means of friction welding.

The aforementioned connections between the rotor cup and rotor shaft in total have the disadvantage that either the connection is relatively heavy, which has a very disadvantageous effect on the acceleration capacity of the spinning rotor, or a change in structure occurs in the components in the course of the attachment of the two rotor parts and this is not unproblematic because of the high rotational speeds of such spinning rotors.

SUMMARY OF THE INVENTION

Proceeding from the aforementioned prior art, the invention is based on the object of providing a spinning rotor for an open end rotor spinning machine, which does not have the disadvantages of the known spinning rotors. In other words, a spinning rotor is to be developed, which has a secure connection between the rotor cup and rotor shaft and also has a relatively low mass moment of inertia.

To achieve this object, a spinning rotor (1) for an open end rotor spinning machine is proposed which comprises a rotor shaft (2), a rotor cup (3), which has an opening (4), an inner chamber (5), a rotor groove (6), a conically widening slide wall (7) extending from the opening (4) to the rotor groove (6) and a rotor base (9) arranged opposing the opening (4) and designed with a bore (8), through which the rotor shaft (2) extends at least partially. The rotor shaft (2) is connected by means of a connection element (10) to the rotor cup (3) and the rotor shaft (2) and rotor cup (3) comprise a common rotational axis (13). The rotor shaft (2) and the rotor cup (3) have connection means (11, 12), which are at least partially surrounded by the connection element (10) configured as a cast part, so a positive connection of the rotor shaft (2) to the rotor cup (3) can be achieved.

Preferred further developments are discussed below.

It is provided according to the invention that the rotor shaft and the rotor cup have connection means, which are at least partially surrounded by a connection element configured as a cast part, so a positive connection of the rotor shaft to the rotor cup can be achieved. An embodiment of this type of the spinning rotor provides, at the connection point between the rotor shaft and rotor cup, a shaft-hub connection, with which a considerable saving in mass of the spinning rotor can be achieved, the rotor shaft and the rotor cup being substantially non-rotationally connected by the positive connection. The above described configuration means that the mass moment of inertia of the spinning rotor can be significantly reduced and this, in particular, has an effect on the acceleration behaviour of the spinning rotor. The connection element configured as a cast part also improves the mass distribution of the spinning rotor and therefore its running behaviour at high rotational speeds, without unacceptably weakening the rotor cup in the hub region.

The connection element designed as a cast part and described above can obviously also additionally undergo a material connection at the contact faces on the rotor cup and on the rotor shaft. The manner of the connection at the contact faces is insignificant, however, in conjunction with the present invention.

Preferably, the rotor shaft, in an advantageous embodiment, has a connection means configured as profiling. The profiling arranged on the rotor shaft at the end reaches, in this case, through a bore in the rotor base of the rotor cup partially into the inner chamber of the rotor cup and may have different forms. The profiling may, for example, be designed as an annular groove, as a helical groove or as knurling and is used above all so that the connection element can undergo a positive fit with the rotor shaft. The annular groove, for example, has an indentation, into which the liquid casting compound can completely penetrate. As indicated above, the profiling expediently extends from the free end of the rotor shaft, which projects into the inner chamber of the rotor cup, through the bore of the rotor base into the rotor cup. Owing to a configuration of this type, the connection element is fixed both inside and outside the rotor cup peripherally with respect to the rotor shaft.

The connection means configured as openings and arranged in the rotor base of the rotor cup serve this purpose. The connection element, which is configured in one piece, extends from the outside of the rotor cup through the openings on the rotor base into the inner chamber of the rotor cup and thus contributes substantially to a good positive fit. In other words, the connection element configured as a one-piece cast part ensures a reliable connection of the rotor shaft and rotor cup.

It is preferred that the diecasting, in this case, advantageously consists of a metal, in particular of Al, Zn, Mg, Ag, Cu, Au, Si, Fe, Ti, Ge, Sn or the like or is formed from an alloy of these metals.

It is also preferred that the connection element configured as a cast part is produced in such a way that the rotor cup is firstly guided into a corresponding device, for example into an insertion tool, of a diecasting machine and is fixed accordingly there. The rotor shaft is then guided into the bore of the rotor cup and also fixed there by means of a corresponding device. The connection region, which is the connection element after the diecasting method, is then covered by a casting mould, which forms an outer shell for the casting compound. In a possible embodiment, the material of the casting compound is, for example, zinc. The liquid casting compound is conveyed into the casting mould at a corresponding pressure, which may be 400 to 600 bar, for example. Once the casting compound has cooled, it forms a reliable, non-releasable connection between the rotor shaft and rotor cup.

In a further advantageous configuration of the spinning rotor, the rotor shaft and the bore in the rotor base are configured in such a way that the rotor shaft is inserted in the bore with clearance before the diecasting method is started. The clearance is used, inter alia, to reliably align the rotor shaft in the bore by means of the centring tool. The clearance is expediently less than 3 mm, preferably less than 1 mm. In the cooled state of the casting compound, the clearance is filled by the connection element.

Furthermore, it is conceivable, to further reduce the rotor run-up time until the desired rotational operating speed of the spinning rotor is reached in that the wall thickness of the rotor cup, in particular the wall thickness of the slide wall, is correspondingly reduced. The slide wall expediently has a wall thickness d, which is in the range of $0.5\ \text{mm} \leqq d \leqq 1.5$ mm, preferably in the range of $0.6\ \text{mm} \leqq d \leqq 0.8$ mm. By means of improving measures of this type, the energy consumption per spinning station can also be considerably reduced.

In the open end rotor spinning machines generally designed as a multi-station textile machine this leads to a considerable cost saving per machine. Furthermore, said features according to the invention bring about an improved operating behaviour of the spinning rotor, of the drive element and the mounting and therefore a higher operating safety with a simultaneously greater degree of use, which is connected with an increase in productivity.

BRIEF DESCRIPTION OF THE DRAWINGS

The invention will be described below in more detail with the aid of an embodiment shown in the drawings, in which.

DETAILED DESCRIPTION OF THE PREFERRED EMBODIMENTS

Figure 1:
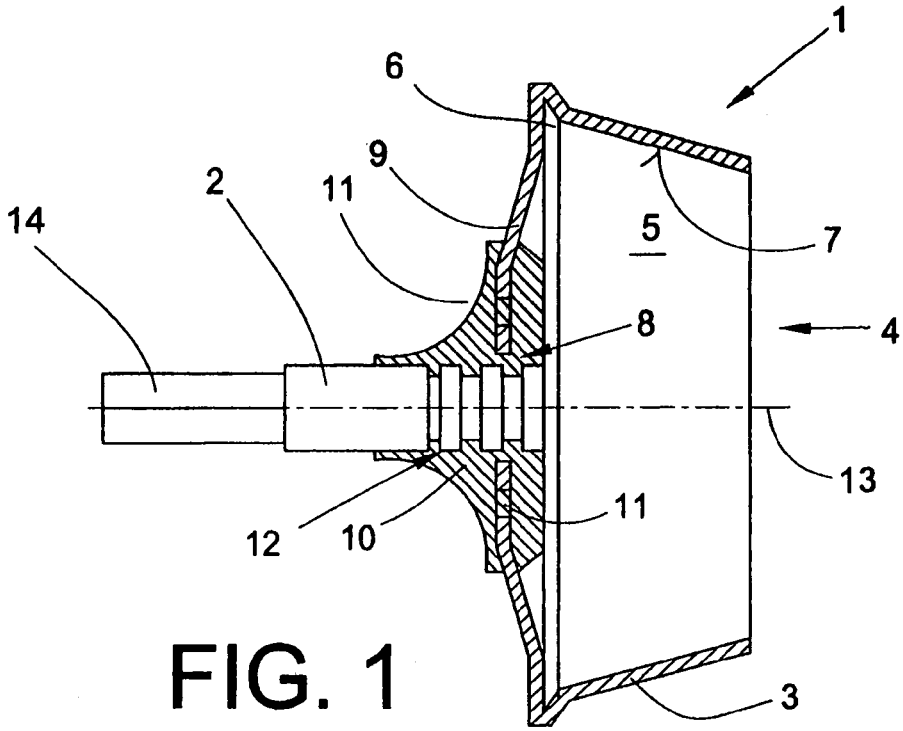
FIG. 1 shows a sectional view of the spinning rotor according to the invention.

FIG. 1 shows a spinning rotor 1 of an open end rotor spinning machine which is known per se and therefore not shown explicitly. As described in relative detail, for example in EP 0 972 868 A2, such open end rotor spinning machines, in each case, have a rotor housing which can be subjected to reduced pressure, in which the rotor cup 3 of the spinning rotor 1 rotates at a high rotational speed about its central axis 13.

The spinning rotor 1 is in this case driven, for example, by an electric motor single drive. The spinning motor 1 is supported, in this case by its rotor shaft, in a magnetic bearing arrangement, not shown, which fixes the spinning rotor 1 both radially and axially.

In order to be able to dismantle spinning rotors 1 of this type if necessary, in particular the rotor cups 3 subjected to wear, it is known to configure the rotor shafts of spinning rotors of this type in two parts. In other words, the rotor shafts of spinning rotors of this type, as shown in the embodiment, have a rotor shaft portion (not shown) provided with bearing components, which remains in the magnetic bearing, and a rotor shaft portion, on which the rotor cup 3 is fixed and which can be dismantled with the rotor cup 3. This rotor shaft portion connected to the rotor cup 3 is designated as a rotor shaft in the present application for the sake of simplicity and designated by the reference numeral 2. The rotor cup 3, which can be turned, for example, from the solid, has an opening 4, an inner chamber 5, a rotor groove 6, a conically widening slide wall 7 extending from the opening 4 to the rotor groove 6 and a rotor base 9 arranged opposing the opening 4 and designed with a bore 8.

The rotor shaft 2 extends through the opening 8 of the rotor base 9. In other words, the rotor shaft 2 projects into the inner chamber 5 of the rotor cup 3, which, apart from a slide face 7, has the rotor groove 6 being used as a fibre collecting groove.

In an alternative embodiment, the rotor cup 3 can also be configured as a cast part or can be brought into the desired shape from a part shaped without cutting, by machining. The wall thickness of the rotor cup 3 between the opening 4 and the bore 8 is substantially the same size. Obviously, in an embodiment, not shown further, the wall thickness of the rotor cup 3 may vary proceeding from the opening 4 in the direction of the rotor base 9.

The rotor shaft 2 is connected to the rotor cup 3 by means of a one-piece connection element 10. The connection element 10 is formed from a casting compound, the material of which is, for example, zinc in the present embodiment. The zinc diecasting brings about a substantially positive connection of the rotor shaft 2 to the rotor cup 3, the connection element 10 being arranged both outside and inside the rotor cup 3. In order to achieve a particularly high torsional strength of the connection between the rotor shaft 2 and rotor cup 3, the rotor shaft 2 and the rotor plate 3 have corresponding connection means 11, 12, which are at least partially surrounded or covered by the connection element 10 configured as a cast part. The rotor shaft 2 has a profiling 12, for example, at the end, which extends, in the installed state into the inner chamber 5 of the rotor cup 3. The casting compound 10 penetrates into the grooves of the profiling 12 during the diecasting method, so the connection element 10 in the cooled state has a reliable hold on the rotor shaft 2.

Figure 2:
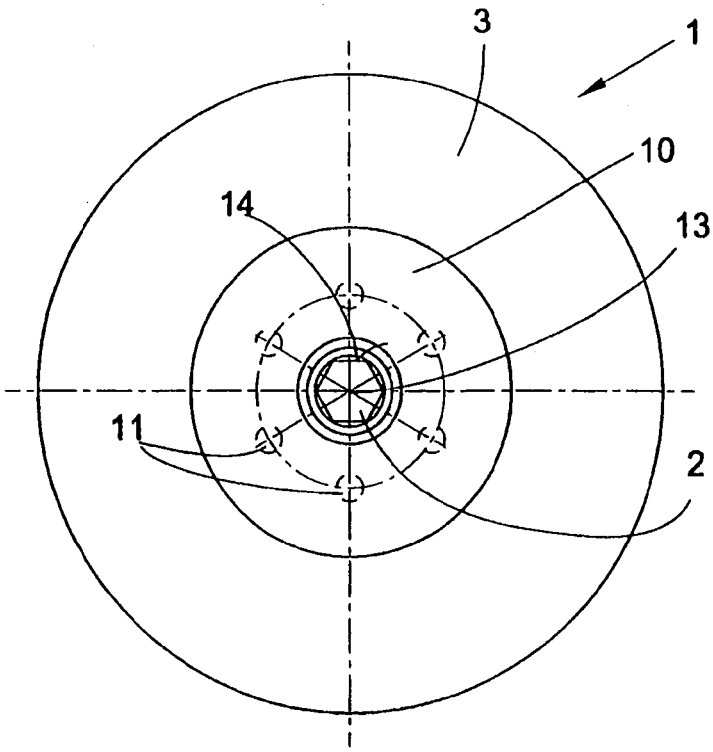
FIG. 2 shows a side view of the spinning rotor according to FIG. 1.

Furthermore, the rotor cup 3 on the rotor base 9 has connection means, which are designed as openings 11, as shown in FIG. 2. The rotor base 9 has six openings 11, for example, which are arranged circularly about the axis of rotation 13. Obviously, a larger or smaller number of openings 11 can be used as connection means for the connection element 10. Preferably, opposing openings 11 are arranged diametrically with respect to one another, so imbalance problems can be substantially ruled out. The circular openings 11 may obviously have alternative geometric shapes, for example square, rectangular or the like.

The connection element 10 extends, proceeding from the rotor shaft outside the rotor cup 3 through the openings 11 into the inner chamber 5 of the rotor cup 3. The one-piece connection element 10 has a positive fit on the profiling 12 of the rotor shaft 2 and on the openings 11 so a secure non-rotational connection is ensured between the rotor cup 3 and rotor shaft 2.

At the same time, owing to the connection element 10 configured as a cast part, the mass moment of inertia of the spinning rotor 1 can be substantially reduced in comparison to the previously conventional connections and this has a favourable effect on the operating behaviour of the spinning rotor.

In the embodiment shown according to FIG. 1, the wall thickness of the connection element 10 firstly increases constantly in the direction of the inner chamber 5 (outside the rotor cup 3) and reaches the greatest wall thickness in the relatively close region of the rotor base 9. The wall thickness then reduces slightly in the inner chamber 5. The present outer contour is determined here by the casting mould.

Obviously, alternative designs of the outer contour are also conceivable, which win not be dealt with explicitly in more detail.

The diameter of the rotor shaft 2 is smaller than the diameter of the central bore 8. In other words, there is clearance between the rotor shaft 2 and the bore 8, which in the embodiment shown is about 1 mm. On the side remote from the inner chamber 5, the rotor shaft 2 is equipped with a hexagon head 14, which in conjunction with a corresponding hexagon socket, not shown, on a rotor shaft portion, which remains in the magnetic bearing, forms a positive anti-twist device.

The rotor cup 3, in the present embodiment, as known, consists of a steel and is boron-treated. Furthermore, the rotor cup 3, as also known, also has a diamond dispersion coating. The rotor shaft 2 is also manufactured from a steel, which in the present embodiment, is a chrome steel.

The connection element 10 is a three-dimensionally formed connection element 10, which abuts the openings 11, the bore 8, the rotor shaft 2, the profiling 12 and the contact faces of the rotor shaft 2 with the base 9 and therefore has a high strength and security against rotation, without having a negative effect on the mass moment of inertia of the spinning rotor 1.

The invention claimed is:

1. Spinning rotor (1) for an open end rotor spinning machine comprising a rotor shaft (2), a rotor cup (3), which has an opening (4), an inner chamber (5), a rotor groove (6), a conically widening slide wall (7) extending from the opening (4) to the rotor groove (6) and a rotor base (9) arranged opposing the opening (4) and designed with a bore (8), through which the rotor shaft (2) extends at least partially, wherein the rotor shaft (2) is connected by means of a connection element (10) to the rotor cup (3) and the rotor shaft (2) and rotor cup (3) comprise a common rotational axis (13), characterised in that the rotor shaft (2) and the rotor cup (3) have connection means (11, 12), which are at least partially surrounded by the connection element (10) configured as a cast part, forming a positive non-releasable connection of the rotor shaft (2) to the rotor cup (3).

2. Spinning rotor according to claim 1, characterised in that the rotor shaft (2) has a connection means (12) configured as profiling.

3. Spinning rotor according to claim 2, characterised in that the profiling (12) is arranged on the rotor shaft (2) at the end and reaches through a bore (8) in the rotor base (9) partially into the inner chamber (5) of the rotor cup (3).

4. Spinning rotor according to claim 3, characterised in that the profiling (12) is designed as an annular groove, as a helical groove or as knurling.

5. Spinning rotor according to claim 1, characterised in that connection means (11), which are configured as openings, are arranged on the rotor base (9) of the rotor cup (3).

6. Spinning rotor according to claim 1, characterised in that the connection element (10) is designed as a one-piece diecasting.

7. Spinning rotor according to claim 6, characterised in that the diecasting (10) is formed from a metal, in particular from Al, Zn, Mg, Ag, Cu, Au, Si, Fe, Ti, Ge, Sn or the like or an alloy made of these metals.

8. Spinning rotor according to claim 1, characterised in that the rotor shaft (2) and the bore (8) in the rotor base (9) are configured in such a way that the rotor shaft (2) is positioned with clearance in the bore (8) prior to casting.

9. Spinning rotor according to claim 8, characterised in that the clearance is less than 3 mm.

10. Spinning rotor according to claim 1, characterised in that the slide wall (7) has a wall thickness (d), which is in the range of $0.5\ \text{mm} \leqq d \leqq 1.5\ \text{mm}$.

11. Open end rotor spinning machine with a spinning rotor (1) according to claim 1.

12. Spinning rotor according to claim 9, characterised in that the clearance is less than 1 mm.

13. Spinning rotor according to claim 10, characterised in that the slide wall (7) has a wall thickness (d) which is in the range of $0.6\ \text{mm} \leqq d \leqq 0.8\ \text{mm}$.

14. Spinning rotor (1) for an open end rotor spinning machine comprising a rotor shaft (2), a rotor cup (3), which has an opening (4), an inner chamber (5), a rotor groove (6), a conically widening slide wall (7) extending from the opening (4) to the rotor groove (6) and a rotor base (9) arranged opposing the opening (4) and designed with a bore (8), through which the rotor shaft (2) extends at least partially, wherein the rotor shaft (2) is connected by means of a connection element (10) to the rotor cup (3) and the rotor shaft (2) and rotor cup (3) comprise a common rotational axis (13), characterised in that the rotor shaft (2) and the rotor cup (3) have connection means (11, 12), which are at least partially surrounded by the connection element (10) configured as a cast part, forming a positive connection of the rotor shaft (2) to the rotor cup (3), wherein the profiling (12) is arranged on the rotor shaft (2) at the end and reaches through a bore (8) in the rotor base (9) partially into the inner chamber (5) of the rotor cup (3).

15. Spinning rotor according to claim 13, characterised in that the profiling (12) is designed as an annular groove, as a helical groove or as knurling.

16. Spinning rotor (1) for an open end rotor spinning machine comprising a rotor shaft (2), a rotor cup (3), which has an opening (4), an inner chamber (5), a rotor groove (6), a conically widening slide wall (7) extending from the opening (4) to the rotor groove (6) and a rotor base (9) arranged opposing the opening (4) and designed with a bore (8), through which the rotor shaft (2) extends at least partially, wherein the rotor shaft (2) is connected by means of a connection element (10) to the rotor cup (3) and the rotor shaft (2) and rotor cup (3) comprise a common rotational axis (13), characterised in that the rotor shaft (2) and the rotor cup (3) have connection means (11, 12), which are at least partially surrounded by the connection element (10) configured as a cast part, forming a positive connection of the rotor shaft (2) to the rotor cup (3), wherein the connection element (10) is designed as a one-piece diecasting formed from a metal, in particular from Al, Zn, Mg, Ag, Cu, Au, Si, Fe, Ti, Ge, Sn or the like or an alloy made of these metals.

* * * * *